US006656569B1

(12) United States Patent
Roussel et al.

(10) Patent No.: US 6,656,569 B1
(45) Date of Patent: Dec. 2, 2003

(54) ABSORBENT PAPER PRODUCT COMPRISING TWO PLIES

(75) Inventors: Gilles Roussel, Durrenentzen (FR); Pierre Laurent, Turckheim (FR); Rémy Ruppel, Durrenentzen (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 09/869,793

(22) PCT Filed: Jan. 5, 2000

(86) PCT No.: PCT/FR00/00007

§ 371 (c)(1), (2), (4) Date: Jul. 5, 2001

(87) PCT Pub. No.: WO00/40800

PCT Pub. Date: Jul. 13, 2000

(30) Foreign Application Priority Data

Jan. 5, 1999 (FR) ..... 99 00033

(51) Int. Cl.[7] ..... B32B 3/00; D06N 7/04

(52) U.S. Cl. ..... 428/154; 428/166; 428/172; 162/113; 156/209; 156/292

(58) Field of Search ..... 428/154, 156, 428/166, 172; 156/209, 290, 291, 292; 162/109, 113

(56) References Cited

U.S. PATENT DOCUMENTS

| | | | | |
|---|---|---|---|---|
| 3,414,459 A | | 12/1968 | Wells | 161/131 |
| 5,173,351 A | | 12/1992 | Ruppel et al. | 428/174 |
| 6,106,928 A | * | 8/2000 | Laurent et al. | 428/152 |

FOREIGN PATENT DOCUMENTS

| | | |
|---|---|---|
| GB | 2 255 745 | 11/1992 |

* cited by examiner

*Primary Examiner*—Donald J. Loney
(74) *Attorney, Agent, or Firm*—Eugene C. Rzucidlo; Greenberg Traurig LLP

(57) ABSTRACT

The invention concerns an absorbent paper product with a basic weight ranging from about 20 to 80 g/m$^2$ comprising an embossed ply including raised designs consisting at least partly of discrete protuberances oriented inwards of the structure and a non-embossed ply. The invention is characterised in that the embossed ply has at least over part of its surface at least 30 protuberances per cm$^2$ whereof the top surface area is less than 1 mm$^2$ preferably less than 0.7 mm$^2$.

12 Claims, 1 Drawing Sheet

ABSORBENT PAPER PRODUCT COMPRISING TWO PLIES

The present invention concerns products made of absorbent paper and more especially of cellulose wadding for sanitary or domestic use and aims to provide for a sheet made up of at least two plies one of which is embossed, intended, essentially, for the making of toilet paper but also for handkerchiefs, serviettes and general purpose wipes.

In the sanitary and domestic paper industry absorbent paper, generally creped and of low weight, is used for the making of these products, called: cellulose wadding or soft tissue. The most use is made of the structures capacity for stretching conferred, for example, by the creping in order to emboss the sheet, i.e. to deform it permanently in places and to obtain protuberances on one face corresponding to hollow zones on the other face.

In effect, the trend over the last few years concerning hygiene products has been to make them softer and smoother by working on their characteristics of thickness and strength, notably by embossing. The latter further allows improvement of the product's visual attraction. The embossing process can be carried out either on paper with a high moisture content, i.e. in the wet end of the paper machine, or on paper with a low moisture content, i.e. during processing. The present invention concerns paper processed in the dry end.

The most widespread patterns of the embossing are made up of a repetition of basic protuberance with a small transverse section and a simple geometric form on a geometric basis. An example is described in U.S. Pat. No. 3,414,459 which focuses on a two- or three-ply sheet, i.e. made up of a plurality of single sheets, called plies, stuck or bonded together. The plies are embossed with a frequency of distribution and height of the protuberances adapted to the making of water absorbing products such as general purpose wipes, the number of elements going from 5 to 30 per $cm^2$. Furthermore, the Applicant has developed, notably for toilet paper, some patterns whose number of elements is greater, going from 30 to 80 per $cm^2$. In this case, because of their number, these elements form protuberances with a lesser height and necessarily have an elementary surface at the top which is also very small, less than 1 $mm^2$. For these last embodiments an appearance which imitates that of a woven product is obtained. An example is described in Patent EP 426,548.

This type of embossing affects mainly the characteristics linked to the thickness of the sheet, on the one hand, and to its rigidity and strength, on the other. These patterns allow a good compromise to be reached between the desired improvements of the characteristics when the semi-finished product becomes the finished product, and the conditions of industrial operation; they allow, notably, the application of a sufficient intensity of embossing. However, they present limited visual appeal.

Other absorbent paper products are made up of two plies but made using a different method of joining them together. On the one hand, one ply or a group of two superposed plies is embossed and, on the other, a second ply is embossed by means of two distinct embossing devices. The first ply as well as the second are embossed according to the raised patterns formed by the protuberances. The pattern density remains necessarily low: less than 20 protuberances/$cm^2$ for this type of product. In effect the two plies are joined together by means of a matchmaker cylinder in such a way that the distal surfaces of the protuberances of the two superposed plies are placed opposite the surfaces situated between two protuberances in the plane of the second ply. This technique is still called the "nested" process. With a structure of this type it is sought to obtain products which are thick and are soft to the touch. However, especially for its application to toilet paper, softness is not optimal because of relatively coarse embossing. Furthermore, it is necessary to emboss heavily to obtain the considerable desired thickness.

In both methods of making a double sheet, both plies are embossed. If embossing gives thickness to each of the two plies it leads, however, to a noticeable reduction of their resistance to tearing. In effect, the mechanical work on the sheet is accompanied by a relaxation of the inter-fibre links in the embossed zones.

Thus, the prime objective of the invention is the production of a double sheet whose resistance to tearing is improved compared to an embossed double sheet of the same thickness.

Conversely, by increasing the pressure of the embossing the thickness of the sheet and/or the quality of the pattern marking of the embossing are increased but the process is limited by the necessity of not inducing too great a loss of resistance to tearing.

The second objective of the invention is the production of a double sheet whose thickness and/or visibility of the embossing pattern is improved, compared to an embossed double sheet in the prior art, while showing good resistance to tearing.

In accordance with the invention, a sheet satisfying one or the other of the two objectives set out above, made up of two plies of cellulose wadding each with a grammage of 10 to 40g/$m^2$, one of which is embossed with relief patterns, consisting at least in part of discrete protuberances orientated towards the interior of the sheet, and the other is not embossed, is characterized in that the embossed ply has, on at least one part of its surface, at least 30 protuberances per $cm^2$ whose surface area on the top is less than 1 $mm^2$, preferably less than 0.7 $mm^2$.

In effect, the Applicant has noted with surprise that a double sheet so characterized has the same thickness as a double sheet made with two plies embossed in the same way as the embossed ply of the invention and assembled in points/points position.

This property has only been observed for pattern densities at least equal to 30 spikes per $cm^2$ on portions of the surface covering at least 30% of the total surface.

The surface of the tops of the protuberances is all the smaller the higher the number of these protuberances is locally. It is preferably inferior to 0.7 $mm^2$ for 30 protuberances per $cm^2$ and preferably inferior or equal to 0.4 $mm^2$ for 50 protuberances per $cm^2$.

By thickness, in the present technical field, is understood thickness measured on a stack of a certain number of sheets (12 plies, for example) on which a light pressure (e.g. 2 kPa) is exerted. It follows that the thickness takes into account a certain resistance to crushing of the structure. Thus without wanting to be bound by an explanation, conservation of the thickness of the structure of the invention results from the best resistance to crushing of a ply that has been embossed with a pattern with a high density.

In accordance with another feature, the product according to the invention has at least 30 protuberances per $cm^2$ on at least 50% of the total surface.

In accordance with another feature the number of protuberances is at least 50 per $cm^2$.

In accordance with another feature the product has a second embossed pattern between said portions of the surface. Advantageously, this pattern can be of a linear type, i.e. made up of protuberances whose surface at the top is in linear form.

The invention is described in more detail in the presentation which follows of an embodiment with the drawings attached, in which.

Figure 1:
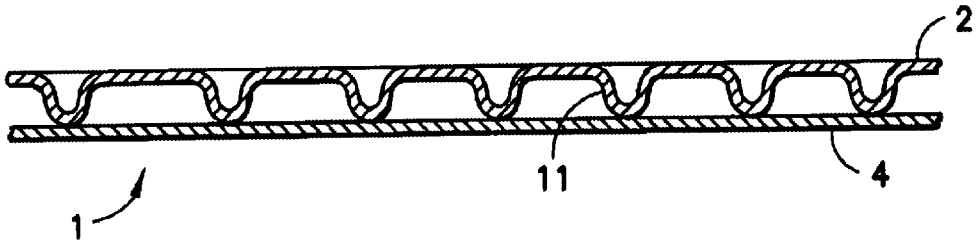
FIG. 1 illustrates schematically an enlarged cross section of the structure embodied according to the invention.

Referring to FIG. 1, the product 1 according to the invention comprises two plies, an embossed ply 2 and a ply which is smooth or not embossed 4. The embossed ply comprises protuberances 11 laid out following a planned constant spacing on one portion of the surface. In the structure of the product in accordance with the invention, the protuberances of the embossed ply are orientated towards the interior. The two plies are preferably bonded to each other. In particular, they can be bonded to each other at the distal surfaces of the protuberances of the embossed ply. Advantageously the two plies are adhesively bonded.

The product in accordance with the invention has a grammage of around 20 to 80g/m$^2$. Each of the plies is made of cellulose wadding. The cellulose wadding is a crepe paper with a low grammage between 10 and 40g/cm$^2$ which has been dried on a heated cylinder and detached from it by means of a metallic strip, called a creping scraper.

On portions of the surface together representing at least 30% of the total surface, the embossed ply has a pattern density higher than 30 protuberances per cm$^2$ and less than 300, preferably a density less than 90 protuberances/cm$^2$. It can further have one or several different types of pattern whose density of pattern is different. The protuberances can then be of different height and the ply can have patterns of different levels. European Patent Applications No. 0 426 548 and No. 0 797 705 illustrate embossed products in accordance with these principles but comprising two embossed plies.

In the product according to the invention, the second ply is not embossed.

The fibrous and/or chemical composition of the plies can be identical or different. For instance, the non-embossed ply can have a fibrous composition essentially based on long fibres such as resinous fibres, and the embossed ply a fibrous composition essentially based on short fibres. This combination allows a stronger product to be obtained without sacrificing the softness given by the short fibres. The non-embossed ply can comprise an additive which is temporarily or possibly permanently resistant to moisture. If this additive is already present in a certain quantity in the embossed ply, the non-embossed ply will be able to contain a larger quantity thereof. An example of a moisture-resistant additive is a compound of the polyamine epichlorohydrin type, sold under the name of KYMENE SLX by the HERCULES company. The embossed ply can comprise a softener or loosening agent. The sheet thus constituted gives a very good resistance to moisture and also a good solidity due in particular to the composition of the non-embossed ply. Furthermore it offers a surface softness by the choice of the fibrous and chemical composition of the embossed ply.

Each ply can further be constituted of one or several layers forming a laminate. The layers in this case can also have a different fibrous and/or chemical composition.

The sheet has been illustrated with the two plies 2 and 4 superposed. They are placed in such a way that the protuberances are on the interior of the sheet. The two plies can be bonded together by any way known to the person skilled in the art, such as, for example, mechanically by roll embossing, i.e. by passing the sheet through a knurling wheel and a smooth counter cylinder.

Preferably, however, the two plies are linked together by means of an adhesive substance interposed between the tops of the protuberances of the illustrated plies which come into contact. The adhesive substance is then preferably placed on the highest peaks of the pattern elements and is advantageously colored in order to make the details stand out. Thus, when the embossed ply has protuberances whose peaks are at different levels, a product which is only partly joined together over a small surface is produced. A particularly supple product is obtained when the surface is less than 5%.

Figure 2:
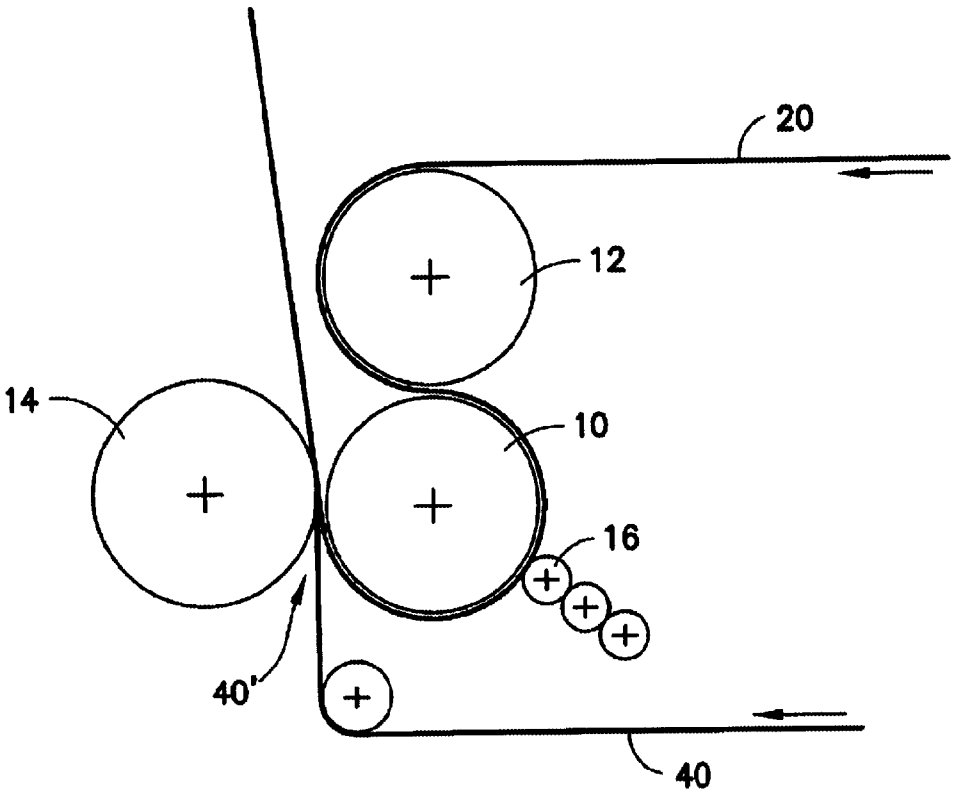
FIG. 2 illustrates an installation allowing manufacture of the invention.

FIG. 2 shows a machine which allows the manufacture of such a sheet's structure. It is made up essentially of elements forming part of the state of the art. A first embossing cylinder 10 has been engraved in accordance with a pattern with spikes in a form adapted to the desired protuberances. The process consists of embossing one ply of cellulose wadding 20, unwinding off a roller (not shown), between the embossing cylinder 10 and a rubber cylinder 12 then assembling by means of a matchmaking cylinder 14 one ply of non-embossed cellulose wadding 40, also unwinding from a roller (not shown), on to the first 20 while it is still in contact with the embossing cylinder. The adhesive substance, preferably water-based, having first been applied, if need be, to the peaks of the embossed ply, by means of an adhesive-applying cylinder 16.

The products in accordance with the invention present very advantageous characteristics compared to products on the market made up of two plies.

This is illustrated by the following example wherein, from sheets of cellulose wadding of hygienic paper quality and different grammage, products were produced according to a standard technique (references 1 and 3) such as those sold under the trademark LOTUS, and products (references 2 and 4) according to the invention, i.e. with a single embossed ply.

In example A, the pattern is that which is currently marketed under the trademark LOTUS and comprises 80 protuberances per cm$^2$. The surface at the top of the protuberances is less than 0.4 mm$^2$. The standard product is joined together in the points/points manner.

In example B, the pattern is made up of protuberances whose surface on the top is also less than 1 mm$^2$. They are laid out according to lines along which the density of the pattern is greater than 30 protuberances per cm$^2$, the lines being separated one from the other by spacings sufficient to allow assembly in a nested position. The average density is 15p/cm$^2$. Such a design is described in the Patent Application submitted by the Applicant under number FR 98 05147 on the Apr. 24 1998.

In example C, the pattern is the same as for B but the specific pressure of embossing was greater. This gives a greater thickness than for the standard product assembled in "nested" form.

| | Standard 1 | Invention 2 | Standard 3 | Invention 4 |
|---|---|---|---|---|
| Number of plies per sheet | 2 | 2 | 2 | 2 |
| Grammage of sheet in g/m$^2$ | 32.3 | 32.1 | 44 | 43.8 |
| 0) Control sheet made with two non-embossed plies | | | | |
| Thickness in mm | 0.19 | 0.19 | 0.31 | 0.31 |

-continued

| | Standard 1 | Invention 2 | Standard 3 | Invention 4 |
|---|---|---|---|---|
| Strength in N/m: | | | | |
| Transverse direction TD | 92 | 90 | 76 | 74 |
| Forwards direction FD | 174 | 158 | 214 | 216 |
| Lengthening | 27% | 27% | 34% | 33% |
| A) Processing of two plies: embossed with pattern of 80p/cm$^2$ and points/points assembly for the standard product. | | | | |
| Number of embossed plies per sheet | 2 | 1 | 2 | 1 |
| Thickness in mm of one sheet (difference compared to control) | 0.27 (+42%) | 0.27 (+42%) | 0.32 (+3%) | 0.32 (+3%) |
| Strength of product in N/m (deviation/control) | | | | |
| Transverse direction TD | 75 (−18%) | 80 (−11%) | 67 (−12%) | 70 (−5%) |
| Forwards direction FD | 147 (−15%) | 157 (−1%) | 190 (−11%) | 200 (−7%) |
| Lengthening | 23% | 25% | 28% | 30% |
| B) Processing of two plies: embossed with pattern of on average 15 p/cm$^2$, "nested" assembly for the standard. | | | | |
| Number of embossed plies | 2 | 1 | 2 | 1 |
| Thickness of sheet (mm) | 0.30 | 0.31 | 0.41 | 0.38 |
| Strength of product: TD (N/m) | 85 | 96 | 64 | 70 |
| C) Processing of two plies: embossed with pattern of on average 15 p/cm$^2$, "nested" assembly for the standard. | | | | |
| Number of embossed plies | 2 | 1 | | |
| Thickness of sheet (mm) | 0.30 | 0.36 | | |
| Strength of product: TD (N/m) | 85 | 86 | | |

Case A—Comparison With a Standard Product Assembled points/points.

Comparing columns 1 and 2, it will be unexpectedly observed that if respective embossing pressures are applied, during the processing of the standard product and the product of the invention, in order to obtain the same thickness (0.27 mm) in both cases, much less strength is lost with the product of the invention. In fact, in the example, the same embossing pressure is used for the standard product and for the product of the invention. Thus, for the product of the invention, by embossing and the processing operation only 1% strength in the forwards direction and 11% strength in the transverse direction have been lost whereas in the standard product of the prior art 15% and 18% respectively have been lost. The same observation can be made when considering columns 3 and 4. With the plies joined together as in the invention, processing leads to a loss of only 5 and 7% against 12 and 11% to obtain the same thickness of product, 0.32 mm.

Furthermore, the softness of the product of the invention is not, rather surprisingly, depleted compared to the standard product. A consumer test carried out with a panel of 20 people, during which they were asked to give their opinion on the softness of the products of the present case, gave the following results (in a scale going from −3 to +3):

Standard product (1): 1.6+/−0.2

Product of the invention (2): 1.7+/−0.2

Standard product (3): 2+/−0.2

Product of the invention (4): 2+/−0.2

Case B—Comparison With a Standard Product Assembled "nested"

Comparing the results of columns 1 and 2 to each other or 3 and 4, it is noted that by processing the sheets in order to obtain products having more or less the same thickness, the strength of the product of the invention is clearly improved.

Case C—Comparison With a Standard Product Assembled "Nested"

Comparing the results of columns 1 and 2, it is noted that in aiming for the production of products presenting the same strength in a transverse direction, the ply can be embossed more intensively in the case of the invention. A thickness of 0.36 mm is obtained for the sheet of the invention against only 0.30 mm for the standard product. From the consumer's point of view, a thicker sheet with an appearance improved by clearer marking without sacrificing its mechanical strength is therefore produced.

As a counter example, a product embossed with a design made up of protuberances on the engraved cylinder 1.3 mm high and at the rate of 7 per cm$^2$ was produced. The standard process with "nested" assembly of two embossed plies gives a sheet 0.28 mm thick for a strength in transverse direction of 80 N/m. In the same conditions a product with a single embossed ply gives a loss of thickness of nearly 20% even if a slight increase in strength, less than 9%, is noted. By increasing the pressure a similar thickness is obtained only at the cost of greatly reduced strength.

In accordance with another embodiment of the invention, an engraved cylinder 10 having first and second spikes is used. The first spikes are laid out according to a first pattern having on at least one portion of the surface at least 30 spikes per cm$^2$, preferably 50 spikes per cm$^2$. The second spikes are laid out according to a second design, the number of second spikes being lower. The tops of the second spikes are at a higher level than those of the first spikes. Thus the cylinder allows the embossing of one ply 20 in accordance with first protuberances corresponding to the first spikes and second protuberances corresponding to the second spikes. Embossing is at two levels. Because of their prominence, the second protuberances of ply 20 formed on the cylinder 10 receive the adhesive from the adhesive-applying cylinder 16. The bond with the non-embossed ply 40 is thus assured by the second protuberances. In accordance with this other method of production a second non-embossed ply 40', represented by an arrow in FIG. 2, is introduced between cylinder 10 thus engraved and the <<matchmaker>> cylinder 14. By correct choice of the amount of adhesive applied to the second protuberances of ply 20 and the pressure of the <<matchmaker>> cylinder, a spread of adhesive on the two faces of ply 40'and the formation of a bond between ply 40' and ply 40 at the top of the second protuberances, is assured. A three-ply product, both thick and supple, is thus obtained. In place of applying the adhesive on the tops of the protuberances it can be sprayed onto the two faces of the first non-embossed ply.

What is claimed is:

1. An absorbent paper product a grammage of about 20 to about 80 g/m$^2$ comprising an embossed ply bearing patterns in relief consisting at least in part of discrete protuberances orientated towards an interior of the product and joined to a non-embossed ply, characterized by the embossed ply having, on at least 30% of a surface of the embossed ply, at least 30 protuberances per cm$^2$ wherein a surface of a top of the protuberances is less than 1 mm$^2$.

2. Product in accordance with claim 1, characterized by the embossed ply having, on at least 50% of the total surface at least 30 protuberances per $cm^2$.

3. Product in accordance with claim 1, characterized by the number of protuberances being at least 50 per $cm^2$, and the surface at the top of the protuberances being less than or equal to 0.4 $mm^2$.

4. Product in accordance with claim 2, characterized by the number of protuberances being at least 50 per $cm^2$, and the surface at the top of the protuberances being less than or equal to 0.4 $mm^2$.

5. Product in accordance with claim 1, charecterized by having second pattern of embossing protuberances between said portions of the surface.

6. Product in accordance with claim 2, characterized by having a second pattern of embossing protuberances between said portions of the surface.

7. Product in accordance with claim 1, wherein the surface at the top of the protuberances is less than 0.7 $mm^2$.

8. Product in accordance with claim 1, characterized by the, plies being joined together by bonding the distal surfaces of at least some of the protuberances of the embossed ply to said non-embossed ply.

9. Product in accordance with claim 8 characterized by the bond being obtained by sticking the protuberances of the second design at least in part.

10. Product in accordance with claim 6, characterized by the bond being obtained by sticking the protuberances of the second design at least in part.

11. Product in accordance with claim 5, characterized by having a second non-embossed ply.

12. Process for producing a product according to claim 11, characterized by consisting of embossing one ply of paper on an engraved cylinder having spikes whose tops are at different levels, of putting into contact a group made up of two superposed plies of non-embossed paper with the tops of said protuberances by means of an adhesive and of exerting pressure to ensure the embossed ply bonds with the two non-embossed plies.

* * * * *